US007819263B1

(12) United States Patent
DiCarlo-Nelson

(10) Patent No.: US 7,819,263 B1
(45) Date of Patent: Oct. 26, 2010

(54) COLLAPSIBLE BABY BOTTLE AND ASSOCIATED METHOD

(76) Inventor: Francesca DiCarlo-Nelson, 312 Kipp Ave., Hasbrouck Heights, NJ (US) 07604

( * ) Notice: Subject to any disclaimer, the term of this patent is extended or adjusted under 35 U.S.C. 154(b) by 110 days.

(21) Appl. No.: 12/006,692

(22) Filed: Jan. 4, 2008

Related U.S. Application Data

(60) Provisional application No. 60/878,432, filed on Jan. 4, 2007.

(51) Int. Cl.
*A61J 9/00* (2006.01)

(52) U.S. Cl. ..... 215/11.3; 215/11.1; 215/11.6; 215/306; 220/666; 220/495.06

(58) Field of Classification Search ..... 215/11.3, 215/11.1, 11.6, 306; 220/666, 495.06
See application file for complete search history.

(56) References Cited

U.S. PATENT DOCUMENTS 3,143,429 A * 8/1964 Swanson et al. ..... 426/117
3,902,618 A * 9/1975 Guerster et al. ..... 215/11.1
D251,612 S * 4/1979 Lagergren et al. ..... D24/197
4,779,722 A * 10/1988 Hall ..... 206/221
5,419,445 A * 5/1995 Kaesemeyer ..... 215/11.1
5,653,353 A * 8/1997 Otto et al. ..... 215/306
5,788,369 A * 8/1998 Tseng ..... 366/130
D401,344 S * 11/1998 Bonds ..... D24/197
5,878,898 A * 3/1999 Shefflin ..... 215/11.6
6,089,389 A * 7/2000 Sharon et al. ..... 215/11.1
D449,381 S * 10/2001 de Begon de Larouziere ..... D24/197
D451,200 S * 11/2001 Johansen et al. ..... D24/197
7,100,782 B2 * 9/2006 Hanna ..... 215/11.6
7,604,137 B1 * 10/2009 Boraca et al. ..... 215/6
D606,661 S * 12/2009 Colombo ..... D24/197

* cited by examiner

*Primary Examiner*—Anthony Stashick
*Assistant Examiner*—Cynthia F Collado

(57) ABSTRACT

A collapsible baby bottle for reducing air-intake during feeding operations includes a body formed from disposable material, a plurality of linear ridges concentrically spanning across a non-uniform circumference thereof, and a coupling threadably attached directly to a top opening of the body. The apparatus further includes a nipple removably attached directly to the coupling, a cap removably affixed directly to the coupling for protecting the nipple from undesirable foreign debris and fluids, and a mechanism for preventing formation of powder formula lumps when mixing the powder formula and water within the body so that a homogenous mixture of the powder formula and the water is obtained. The apparatus further includes a strap tethered directly to the coupling and spaced from the body and the nipple respectively, and a barcode removably affixed directly to a bottom surface of the body for identifying nutritional information about the powder formula.

9 Claims, 5 Drawing Sheets

COLLAPSIBLE BABY BOTTLE AND ASSOCIATED METHOD

CROSS REFERENCE TO RELATED APPLICATIONS

This application claims the benefit of U.S. Provisional Application No. 60/878,432, filed Jan. 4, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to baby bottles and, more particularly, to a collapsible baby bottle for reducing air-intake during feeding operations.

2. Prior Art

As a matter of personal preference or as a matter of convenience, many mothers resort to bottle feeding of their infants for the first years of the child's life. During the 1960's the hard glass bottles that were capped by nipples were gradually replaced by collapsible flexible sacks. The sacks preferably were replaceable mounted in a tubular frame for protection during use. Provision was made for coupling the sacks to the nipples. For sanitary reasons, the sacks were intended to be disposable after a single use.

Collapsible sack nursing bottle assemblies have been advertised as reducing the amount of air ingested into an infant's stomach when the liquid baby food is drawn through the nipple from the nursing bottle. Under certain conditions, the use of collapsible sack nursing bottles can have complications. If only one of two ounces of fluid is has been withdrawn from the sack by the infant, forcing the air out of the sack with finger pressure becomes somewhat difficult. Or, if the feeding of the infant is interrupted and the nursing bottle is laid down for a few moments, there can be a reverse flow of air through the nipple into the fluid sack. Preferably, when the bottle is picked up to resume the feeding, the air in the sack should be evacuated before liquid is drawn through the nipple by the infant. Again, the application of finger pressure to the sack to force any air out becomes somewhat difficult.

Furthermore, product safety in the area of child care is becoming increasingly important in today's society. One area of safety that has received little attention, however, is in the area of nursing bottles. Infants are carrying or holding feeding bottles for a good part of their waking hours and the bottle may become a safety hazard in many situations. A recent improvement has been the development of plastic infant bottles to replace glass bottles because of danger from cuts on broken glass after a bottle has shattered due to a fall. There is another aspect of bottle design, however, that has been overlooked. This is in the rigid structure of the bottle itself. In situations where the child is traveling in a vehicle while feeding from a bottle, the bottle may become a dangerous structure which can cause serious injury to the mouth and facial areas of the child in the event of a crash.

U.S. Pat. No. 6,365,202 to Ida discloses a method of feeding an infant utilizing a nursing bottle, having a resilient shell body with at least one aperture, a flexible liner, and a feeding nipple that utilizes air pressure to expel trapped air from a liner. When the aperture or apertures are covered by the operator's finger or hand, and pressure is applied to the shell body, air trapped in the liner can be expelled prior to feeding the infant. Unfortunately, this prior art example does not provide a collapsible bottle that uses the body of the apparatus, rather than the user hand, to expel air from the liner.

U.S. Pat. No. 6,042,850 to Ida discloses a nursing bottle having a body, a flexible liner, and a feeding nipple. In one embodiment, the body includes a check valve to allow air into a chamber formed between the body and the flexible liner to equalize the pressure in the chamber and prevent air from leaving the chamber. This prevents the liner from expanding and air from reentering the liner. Other embodiments of the nursing bottle include a pump for introducing pressurized air into the chamber and thereby expelling air from the liner. In still other embodiments, the bottle comprises a two-part body in which the parts of the body are slidably and sealably engageable with each other wherein movement of the parts relative to each other pressurizes the air in the chamber and expels air from the liner. Disclosed are also methods of feeding an infant or animal utilizing such nursing bottles. Unfortunately, this prior art example is not collapsible in order to enhance storage capabilities.

U.S. Pat. No. 5,921,426 to Randolph discloses a holder, for use with disposable baby feeding liners, and includes a body having a plurality of walls. The walls form at least one pair of opposed walls that are adapted to be compressed to press against a liner contained within the holder to expel air from the liner. In another embodiment, each wall of at least one pair of opposed walls has a wall portion that is adapted to be compressed to press against the liner. In either embodiment, the bottom of the holder is either opened or is a surface having at least one air vent therethrough. Unfortunately, this prior art example is not collapsible in order to enhance storage capabilities.

Accordingly, the present invention is disclosed in order to overcome the above noted shortcomings. The present invention is convenient and easy to use, lightweight yet durable in design, and designed for reducing air-intake during feeding operations. The collapsible baby bottle is simple to use, inexpensive, disposable and recyclable.

BRIEF SUMMARY OF THE INVENTION

In view of the foregoing background, it is therefore an object of the present invention to provide an apparatus for reducing air-intake during feeding operations. These and other objects, features, and advantages of the invention are provided by a collapsible baby bottle.

A collapsible baby bottle for reducing air-intake during feeding operations includes a body formed from disposable material and a plurality of linear ridges concentrically spanning across a non-uniform circumference thereof. Each of such linear ridges effectively defines a line of weakness along which the body is compressed and expanded in such a manner that air is expelled outwardly from the body after being collapsed to a compressed position. The body further includes a plurality of first linear sides extending downwardly and outwardly away from a center of the body, and a plurality of creases juxtaposed intermediately between the linear ridges and spanning along the entire perimeter of the body. Such creases are conveniently registered parallel to the linear ridges respectively, and a plurality of second linear sides extends upwardly and outwardly away from the center of the body. Each of such first and second linear sides has proximal ends directly engaged with corresponding ones of the creases, and each of the first and second linear sides has distal ends directly engaged with corresponding ones of the linear ridges.

The apparatus further includes a coupling threadably attached directly to a top opening of the body, a nipple removably attached directly to the coupling, and a cap removably affixed directly to the coupling for protecting the nipple from undesirable foreign debris and fluids. The apparatus further includes a mechanism for advantageously preventing formation of powder formula lumps when mixing the powder formula and water within the body so that a homogenous mixture of the powder formula and the water is obtained. Such a powder formula lump preventing mechanism includes an annular ring having an outer surface directly and statically engaged with an inner surface of the body. Such a ring is effectively disposed medially between top and bottom ends of the body and further is wedged within a selected one of the linear ridges such that the ring remains at a fixed position while the body is agitated as well as when the body is compressed and expanded respectively. The ring includes first, second, third and fourth monolithically formed linear segments having medial ends aligned with a center of the ring respectively. Each of such first, second, third and fourth linear segments further has lateral ends monolithically formed with the outer surface in such a manner that the first, second, third and fourth linear segments are equidistantly spaced apart along a perimeter of the outer surface.

The apparatus further includes a strap conveniently tethered directly to the coupling and spaced from the body and the nipple respectively, and a barcode removably affixed directly to a bottom surface of the body for identifying nutritional information about the powder formula.

A method for reducing air-intake while feeding liquid formula to an infant includes the steps of: providing a body formed from disposable material and having a plurality of linear ridges concentrically spanning across a non-uniform circumference thereof; adapting the body to an expanded position by expanding each of the linear ridges apart from each other; depositing a predetermined quantity of powder formula and water into the body; removably attaching a nipple directly to a coupling; threadably attaching the coupling directly to a top opening of the body; removably affixing a barcode directly to a bottom surface of the body for identifying a nutritional information about the powder formula; mixing the powder formula and the water within the body while preventing formation of powder formula lumps so that a homogenous mixture of the powder formula and the water is obtained; and selectively adapting the body to compressed position by compressing the linear ridges so that air is expelled outwardly from the body after being collapsed to a fully compressed position.

The method further includes the steps of: providing an annular ring; positioning the ring within the body by directly and statically engaging an outer surface of the ring with an inner surface of the body; and wedging the ring within a selected one of the linear ridges such that the ring remains at a fixed position while the body is agitated as well as when the body is compressed and expanded respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
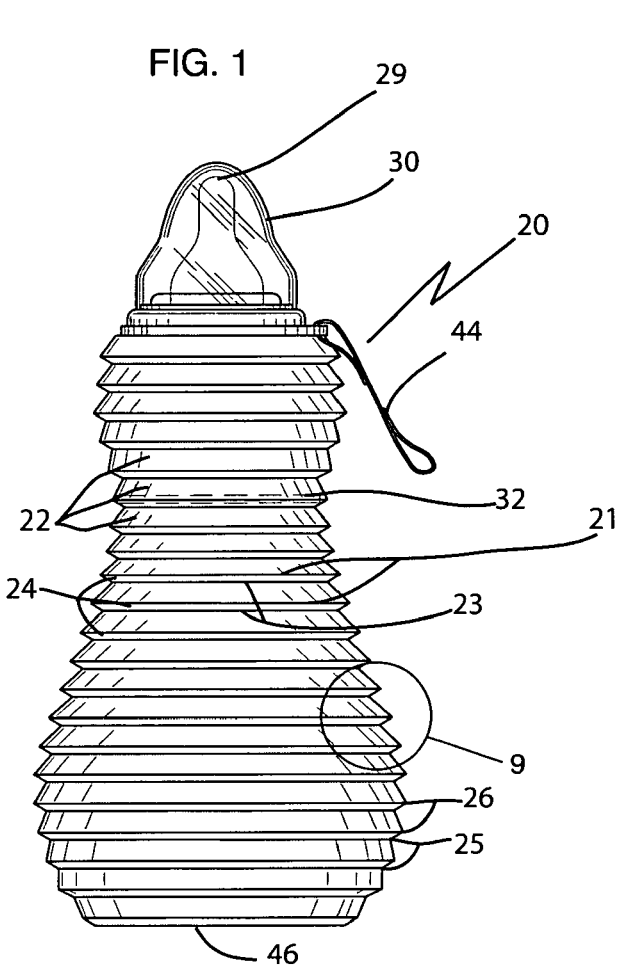
FIG. 1 is a front elevational view showing an hour-glass shaped collapsible baby bottle adapted to an extended position.
Figure 1:
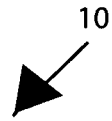
Figure 2:
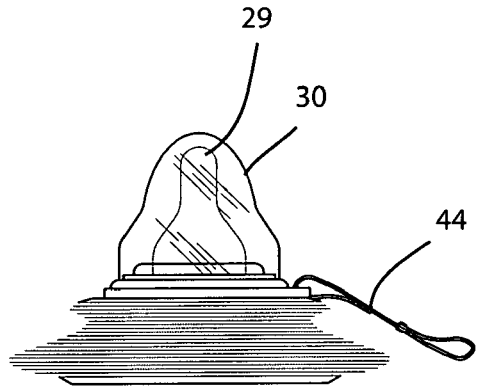
FIG. 2 is a front elevational view showing the collapsible baby bottle adapted to a compressed position wherein air is expelled from an interior of the body.
Figure 3:
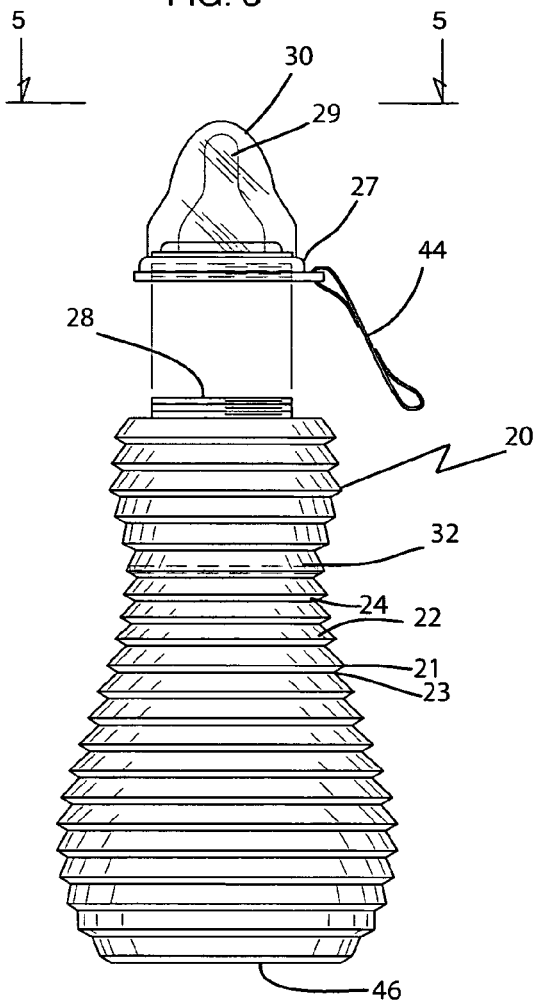
FIG. 3 is an exploded view showing the coupling and nipple detached from the top opening of the baby bottle.
Figure 4:
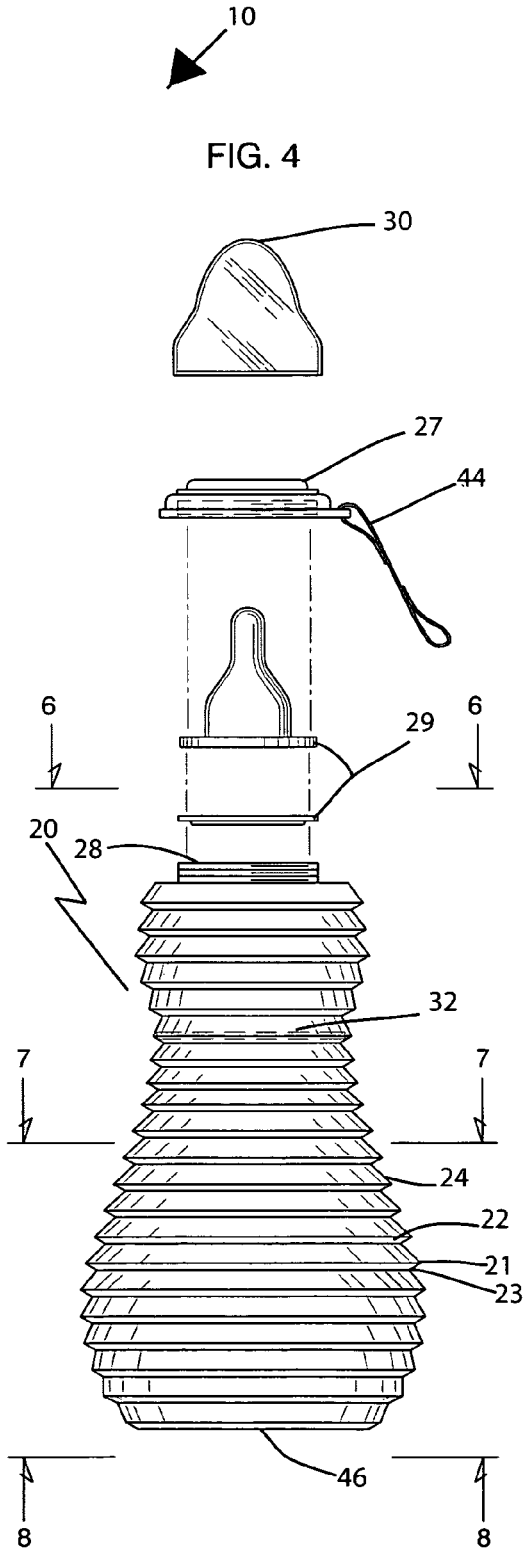
FIG. 4 is another exploded view showing coupling, nipple and cap at separated positions wherein a one-way valve is attached to a top end of the body for used with a fast flow nipple. The coupling has a plurality of raised shoulders that step inwardly towards a top of the coupling so that alternate shaped couplings are used in each stage of the feeding process.
Figure 5:
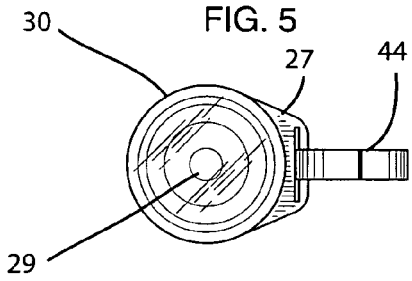
FIG. 5 is a top plan view of FIG. 1 showing a strap tethered to the coupling.
Figure 6:
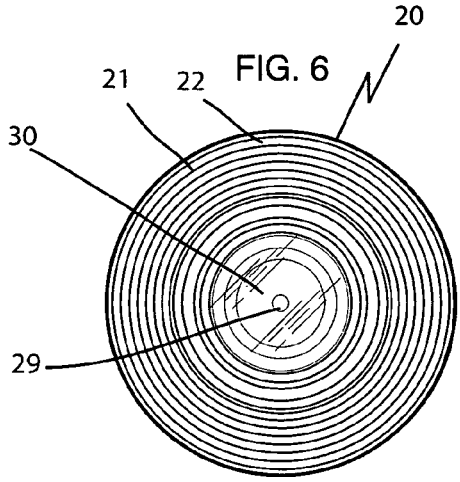
FIG. 6 is a bottom view of the baby bottle showing a concave surface.
Figure 7:
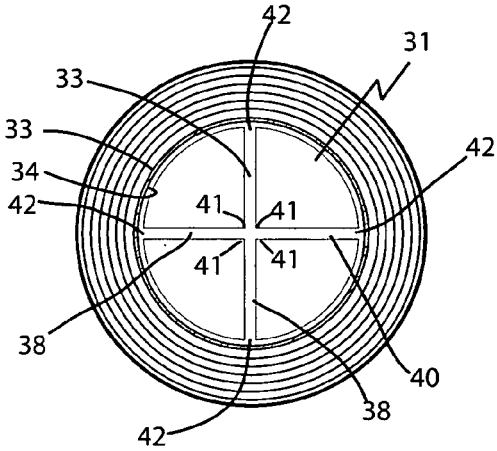
FIG. 7 is a cross-sectional view showing the disk interfitted within a narrowest portion of the baby bottle.
Figure 8:
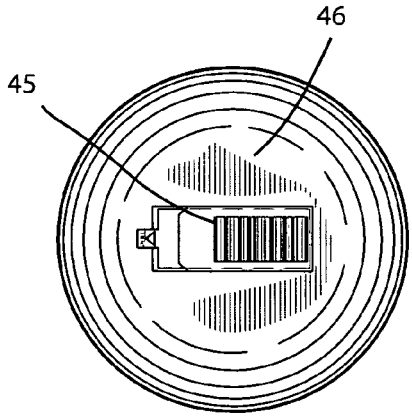
FIG. 8 is a bottom plan view of the baby bottle provided with a bar code removably attached thereto.
Figure 9:
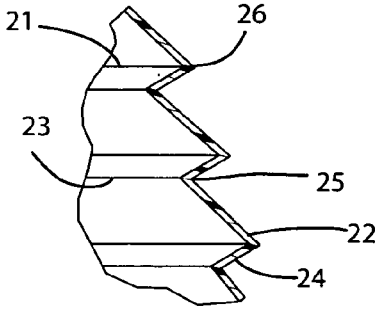
FIGS. 9 and 10 are enlarged cross-sectional views of the baby bottle ridges adapted to expanded and compressed positions.
Figure 10:
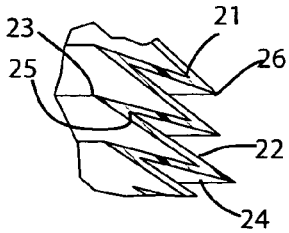
Figure 11:
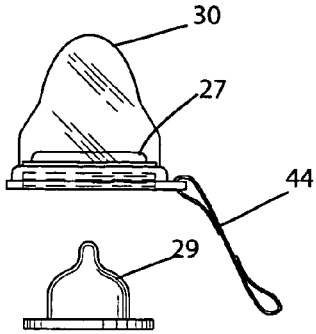
FIG. 11 is a front elevational view showing a slow flow wide nipple embodiment of the present invention wherein a wide base of the nipple causes a baby to open their mouth wider for providing a more easy transition between a mother's breast and the bottle.
Figure 12:
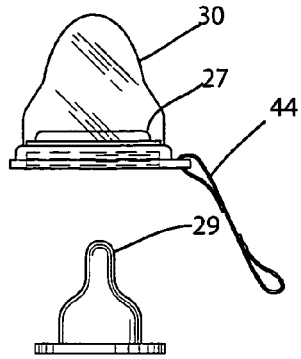
FIG. 12 is a front elevational view showing a medium flow nipple designed to slowly increase fluid flow with a width of the nipple is slightly decreased for allowing the baby to consume the increased fluid flow.
Figure 13:
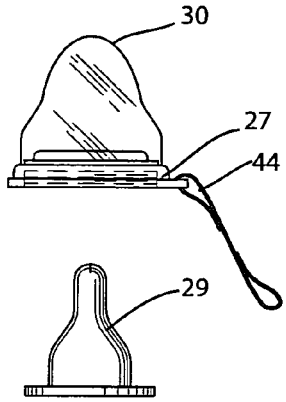
FIG. 13 is a front elevational view showing a fast flow narrow nipple embodiment of the present invention provided with slits at a tip of the nipple wherein a narrow base of the nipple prevents accidental spills while the baby learns to hold the bottle.
Figure 14:
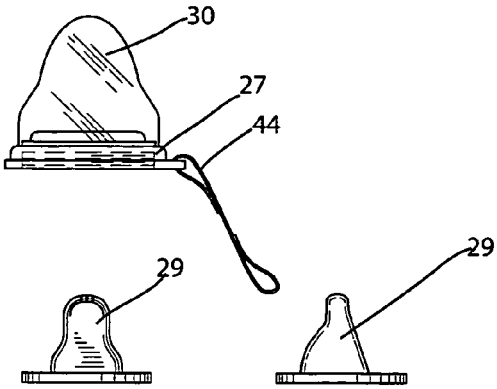
FIG. 14 is a front elevational view showing a silicone sippy top design of the nipple that is provided with a plurality of slits in the top end for regulating fluid flow.
Figure 15:
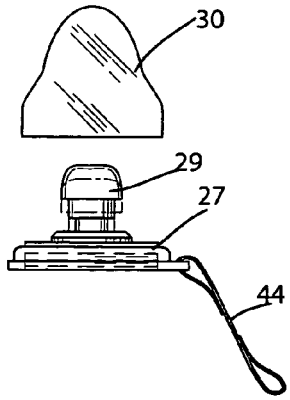
FIG. 15 is a front elevational view of yet another embodiment showing a pop-top style nipple for use with the present invention.
Figure 16:
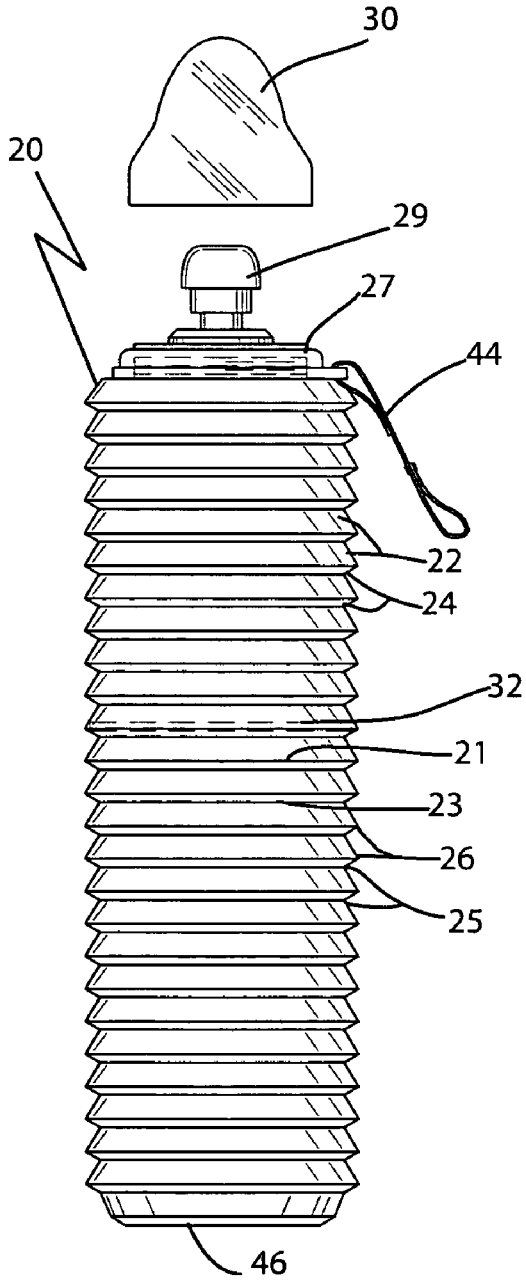
FIG. 16 is a front elevational view of another embodiment showing a straight body provided with a one-way valve formed at a top opening thereof.

The apparatus of this invention is referred to generally in FIGS. 1-15 by the reference numeral 10 and is intended to protect a collapsible baby bottle. It should be understood that the apparatus 10 may be used to protect many different types of bottles and should not be limited to use with only those types of bottles mentioned herein.

Referring initially to FIGS. 1-4, a collapsible baby bottle 10 for reducing air-intake during feeding operations includes a body 20 formed from disposable material and a plurality of linear ridges 21 concentrically spanning across a non-uniform circumference thereof. Each of such linear ridges 21 defines a line of weakness along which the body 20 is compressed and expanded in such a manner that air is expelled outwardly from the body 20 after being collapsed to a compressed position. The body 20 further includes a plurality of first linear sides 22 extending downwardly and outwardly away from a center of the body 20, and a plurality of creases 23 juxtaposed intermediately between the linear ridges 21 and spanning along the entire perimeter of the body 20. Such creases 23 are registered parallel to the linear ridges 21 respectively, and a plurality of second linear sides 24 extends upwardly and outwardly away from the center of the body 20. Each of such first and second linear sides 22, 24 has proximal ends 25 directly engaged, without the use of intervening elements, with corresponding ones of the creases 23, and each of the first and second linear sides 22, 24 has distal ends 26 directly engaged, without the use of intervening elements, with corresponding ones of the linear ridges 21.

Referring to FIGS. 1-15, the apparatus 10 further includes a coupling 27 threadably attached directly, without the use of intervening elements, to a top opening 28 of the body 20, a nipple 29 removably attached directly, without the use of intervening elements, to the coupling 27, and a cap 30 removably affixed directly, without the use of intervening elements, to the coupling 27 for protecting the nipple 29 from undesirable foreign debris and fluids. The apparatus 10 further includes a mechanism 31 for preventing formation of powder formula lumps when mixing the powder formula and water within the body 20 so that a homogenous mixture of the powder formula and the water is obtained.

Such a powder formula lump preventing mechanism 31 includes an annular ring 32 having an outer surface 33 directly and statically engaged, without the use of intervening elements, with an inner surface 34 of the body 20. Such a ring 32 is disposed medially between top and bottom ends 35, 36 of the body 20 and further is wedged within a selected one of the linear ridges 21 which is essential such that the ring 32 remains at a fixed position while the body 20 is agitated as well as when the body 20 is compressed and expanded respectively. The ring 32 includes first, second, third and fourth monolithically formed linear segments 37, 38, 39, 40 having medial ends 41 aligned with a center of the ring 32 respectively. Each of such first, second, third and fourth linear segments 37, 38, 39, 40 further has lateral ends 42 monolithically formed with the outer surface 33 in such a manner that the first, second, third and fourth linear segments 37, 38, 39, 40 are equidistantly spaced apart along a perimeter of the outer surface 33.

Referring to FIGS. 5-10, the apparatus 10 further includes a strap 44 tethered directly, without the use of intervening elements, to the coupling 27 and spaced from the body 20 and the nipple 29 respectively, and a barcode 45 removably affixed directly to a bottom surface 46 of the body 20 for identifying nutritional information about the powder formula.

The apparatus includes a container that is substantially cylindrically-shaped and has an accordion like configuration, which is essential for allowing the walls of the container to easily collapse flat, and preferably may have 1 ounce increments clearly marked on an outer surface thereof. The container may be produced in various iridescent colors which will assist children in identifying colors, yet are easy to see through, as is obvious to a person of ordinary skill in the art. The container is capable of collapsing by more than half the expanded height, thus allowing for easy storage thereof when the container is empty.

As the baby drinks a volume of liquid held within the container by sucking on a nipple or top, the container collapses, which is vital for preventing excess air from entering the baby's tummy, thereby avoiding excessive gas build up in a baby. The container could also be pre-filled, and be ready to use with liquid or powdered formulas, breast milk or a variety of juices contained therein, as is obvious to a person of ordinary skill in the art. The container is produced of sterilized, lightweight plastic material and is meant to be disposed of in a recycling bin when finished. Of course, the container could be produced in a variety of sizes, preferably 4, 6 and 8 ounces, and would also include corresponding nipple and top sizes including slow, medium and fast flow nipples for infants through one year and sippy and pop tops for toddlers and older children, as is obvious to a person of ordinary skill in the art.

The apparatus includes a fitted collar that effectively secures the nipples or tops to a top surface of the bottle. A top is included that is slightly extended on one end and has an aperture formed therein, which is important so a strap can be fastened therethrough. Such a strap is attached to safety belts on car seats, high chairs, strollers, etc., and is advantageous for preventing a child from throwing or dropping the container. The apparatus also includes an annular disk with an "X" formed through the center of the disk that is placed at a center point of the container. Such a disk effectively assists in stabilizing the bottle to stand upright. More importantly, the "X" formed in the disk conveniently assists in mixing powdered formulas or drinks and dissolving lumps in the formula or drink. A valve is monolithically formed with the container below the nipple, which is crucial for assisting in preventing accidental spills. A removable expandable label is directly attached, without the use of intervening elements, on the bottom surface of the container that displays nutrition information, and directions on use.

Each nipple is designed for specific age groups. As a baby grows and demands more fluid and a faster intake of said fluid, the baby will progress through different stages of nipples and tops that incrementally increase the flow of fluid while decreasing the width of the nipple or top, thereby allowing a maturing baby to close its mouth around the nipple or top so the fluid will stay within the baby's mouth and not spill down the baby's face.

In stage 1, the nipple is a slow flow, wide nipple, for ages approximately 0-4 months, and is designed with a wide base causing the baby to open its mouth wide and making the transition from breast to bottle much easier. The second stage is a medium flow nipple, for ages approximately 4-8 months, and is designed to slowly increase the flow while the width of the nipple has decreased slightly, thereby allowing a baby to consume the increased flow. The third stage is a fast flow nipple, for ages approximately 8-12 months, and is designed much narrower and helps prevent accidental spills while a baby learns to hold a bottle. This narrower nipple also prepares a baby for the transition to a sippy top.

The fourth stage, a sippy top, is designed for ages of approximately 1-3 years. In this stage, the top of the nipple is squared off and incorporates no spill slits. The last stage, stage 5, is designed like a pop top on a water bottle and provides easy and convenient use for ages 3 and up. All size bottles and nipples or tops are also interchangeable. Empty bottles can be purchased separately from said nipples or tops. The bottles and nipples or tops will be packaged in quantities of 6, 12, 24 and 48 packs or cartons. For example, a caregiver may purchase a 48 pack of 8 ounce bottles with a 24 pack Stage 3 nipples for a baby, a 12 pack stage 4 sippy top for a toddler and a 12 pack of pop tops for older children. This interchangeability makes it possible to satisfy children of all ages with one size bottle simply by matching corresponding various stage nipples and tops.

The present invention, as claimed, provides the unexpected and unpredictable benefit of an apparatus that is convenient and easy to use, is durable yet lightweight in nature, is versatile in its applications, and provides an easy, safe, healthy, practical, and convenient means of feeding for children. The apparatus can contain nutritious powdered or liquid formula, all natural 100% juices, water, and so on. All the bottles and nipples or tops are advantageously sterilized and sealed for ensuring the infant's safety. The apparatus is compact, lightweight, disposable and 100% recyclable. Such a collapsible bottle is great for use while traveling. The apparatus also saves time, space and money on purchasing bottles that need to be measured, mixed, sterilized, cleaned and stored in sinks, dishwashers and cabinets. The present invention is also microwave, refrigerator and freezer safe, which allows for reheating and storing of the contents thereof. The apparatus may also be incorporated with brand name breast pumps which will benefit breast feeding moms on the go.

In use, a method for reducing air-intake while feeding liquid formula to an infant includes the steps of: providing a body 20 formed from disposable material and having a plurality of linear ridges 21 concentrically spanning across a non-uniform circumference thereof; adapting the body 20 to an expanded position by expanding each of the linear ridges 21 apart from each other; depositing a predetermined quantity of powder formula and water into the body 20; removably attaching a nipple 29 directly, without the use of intervening elements, to a coupling; threadably attaching the coupling 27 directly, without the use of intervening elements, to a top opening of the body 20; removably affixing a barcode 45 directly, without the use of intervening elements, to a bottom surface 46 of the body 20 for identifying a nutritional information about the powder formula; mixing the powder formula and the water within the body 20 while preventing formation of powder formula lumps so that a homogenous mixture of the powder formula and the water is obtained; and selectively adapting the body 20 to compressed position by compressing the linear ridges 21 so that air is expelled outwardly from the body 20 after being collapsed to a fully compressed position.

In use, the method further includes the steps of: providing an annular ring 32; positioning the ring 32 within the body 20 by directly and statically, without the use of intervening elements, engaging an outer surface of the ring 32 with an inner surface of the body 20; and wedging the ring 32 within a selected one of the linear ridges 21 such that the ring 32 remains at a fixed position while the body 20 is agitated as well as when the body 20 is compressed and expanded respectively.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A collapsible baby bottle for reducing air-intake during feeding operations, said collapsible baby bottle comprising:

a body having a plurality of linear ridges concentrically spanning across a non-uniform circumference thereof, each of said linear ridges defining a line of weakness along which said body is selected compressed and expanded in such a manner that air is expelled outwardly from said body after being collapsed to a compressed position;

a coupling threadably attached directly to a top opening of said body;

a nipple removably attached directly to said coupling;

a cap removably affixed directly to said coupling for protecting said nipple from undesirable foreign debris and fluids; and means for preventing formation of powder formula lumps when mixing the powder formula and water within said body so that a homogenous mixture of the powder formula and the water is obtained;

wherein said powder formula lump preventing means comprises:

an annular ring having an outer surface directly and statically engaged with an inner surface of said body, said ring being disposed medially between top and bottom ends of said body and further being wedged within a selected one of said linear ridges such that said ring remains at a fixed position while said body is agitated as well as when said body is compressed and expanded respectively;

wherein said ring comprises:

first, second, third and fourth monolithically formed linear segments having medial ends aligned with a center of said ring respectively, each of said first, second, third and fourth linear segments further having lateral ends monolithically formed with said outer surface in such a manner that said first, second, third and fourth linear segments are equidistantly spaced apart along a perimeter of said outer surface.

2. The collapsible baby bottle of claim 1, wherein said body further comprises:

a plurality of first linear sides extending downwardly and outwardly away from a center of said body;

a plurality of creases juxtaposed intermediately between said linear ridges and spanning along the entire perimeter of said body, said creases being registered parallel to said linear ridges respectively; and a plurality of second linear sides extending upwardly and outwardly away from the center of said body.

3. The collapsible baby bottle of claim 2, wherein each of said first and second linear sides has proximal ends directly engaged with corresponding ones of said creases.

4. The collapsible baby bottle of claim 3, wherein each of said first and second linear sides has distal ends directly engaged with corresponding ones of said linear ridges.

5. A collapsible baby bottle for reducing air-intake during feeding operations, said collapsible baby bottle comprising:

a body formed from disposable material and having a plurality of linear ridges concentrically spanning across a non-uniform circumference thereof, each of said linear ridges defining a line of weakness along which said body is selected compressed and expanded in such a manner that air is expelled outwardly from said body after being collapsed to a compressed position;

a coupling threadably attached directly to a top opening of said body;

a nipple removably attached directly to said coupling;

a cap removably affixed directly to said coupling for protecting said nipple from undesirable foreign debris and fluids;

means for preventing formation of powder formula lumps when mixing the powder formula and water within said body so that a homogenous mixture of the powder formula and the water is obtained;

a strap tethered directly to said coupling and spaced from said body and said nipple respectively; and a barcode removably affixed directly to a bottom surface of said body for identifying a nutritional information about the powder formula;

wherein said powder formula lump preventing means comprises:

an annular ring having an outer surface directly and statically engaged with an inner surface of said body, said ring being disposed medially between top and bottom ends of said body and further being wedged within a selected one of said linear ridges such that said ring remains at a fixed position while said body is agitated as well as when said body is compressed and expanded respectively;

wherein said ring comprises:

first, second, third and fourth monolithically formed linear segments having medial ends aligned with a center of said ring respectively, each of said first, second, third and fourth linear segments further having lateral ends monolithically formed with said outer surface in such a manner that said first, second, third and fourth linear segments are equidistantly spaced apart along a perimeter of said outer surface.

6. The collapsible baby bottle of claim 5, wherein said body further comprises:

a plurality of first linear sides extending downwardly and outwardly away from a center of said body;

a plurality of creases juxtaposed intermediately between said linear ridges and spanning along the entire perimeter of said body, said creases being registered parallel to said linear ridges respectively; and a plurality of second linear sides extending upwardly and outwardly away from the center of said body.

7. The collapsible baby bottle of claim 6, wherein each of said first and second linear sides has proximal ends directly engaged with corresponding ones of said creases.

8. The collapsible baby bottle of claim 7, wherein each of said first and second linear sides has distal ends directly engaged with corresponding ones of said linear ridges.

9. A method for reducing air-intake while feeding liquid formula to an infant, said method comprising the steps of:

a. providing a body formed from disposable material and having a plurality of linear ridges concentrically spanning across a non-uniform circumference thereof;

b. adapting said body to an expanded position by expanding each of said linear ridges apart from each other;

c. depositing a predetermined quantity of powder formula and water into said body;

d. removably attaching a nipple directly to a coupling;

e. threadably attaching said coupling directly to a top opening of said body;

f. removably affixing a barcode directly to a bottom surface of said body for identifying a nutritional information about the powder formula;

g. mixing the powder formula and the water within said body while preventing formation of powder formula lumps so that a homogenous mixture of the powder formula and the water is obtained; and h. selectively adapting said body to compressed position by compressing said linear ridges so that air is expelled outwardly from said body after being collapsed to a fully compressed position;

wherein step g. comprises the steps of:

providing an annular ring;

positioning said ring within said body by directly and statically engaging an outer surface of said ring with an inner surface of said body; and wedging said ring within a selected one of said linear ridges such that said ring remains at a fixed position while said body is agitated as well as when said body is compressed and expanded respectively.

* * * * *